US006488487B2

(12) United States Patent
Minato

(10) Patent No.: US 6,488,487 B2
(45) Date of Patent: Dec. 3, 2002

(54) PULSATION DAMPING DEVICE

(75) Inventor: Yoji Minato, Sanda (JP)

(73) Assignee: Nippon Pillar Packing Co., Ltd. (JP)

( * ) Notice: Subject to any disclaimer, the term of this patent is extended or adjusted under 35 U.S.C. 154(b) by 11 days.

(21) Appl. No.: 09/848,324

(22) Filed: May 4, 2001

(65) Prior Publication Data

US 2001/0043875 A1 Nov. 22, 2001

(30) Foreign Application Priority Data

May 10, 2000 (JP) ..... 2000-137572

(51) Int. Cl.[7] ..... F04B 11/00

(52) U.S. Cl. ..... 417/540; 417/542; 417/394; 138/30

(58) Field of Search ..... 417/540, 542, 417/394; 138/30

(56) References Cited

U.S. PATENT DOCUMENTS 5,129,427 A * 7/1992 White et al. ..... 138/30
5,205,326 A * 4/1993 Paley et al. ..... 138/30
5,516,266 A * 5/1996 Talaski ..... 417/540
6,322,338 B1 * 11/2001 Nishio ..... 138/30

FOREIGN PATENT DOCUMENTS

JP 6-17752 A 1/1994
JP 8-159016 A 6/1996

* cited by examiner

*Primary Examiner*—Charles G. Freay
*Assistant Examiner*—Michael K. Gray
(74) *Attorney, Agent, or Firm*—Griffin & Szipl, P.C.

(57) ABSTRACT

The invention provides a pulsation damping device in which an offset load on a pulsation suppression diaphragm is eliminated while an air supply valve and an air discharge valve are separately and independently juxtaposed, and an extendable and contractible portion of the pulsation suppression diaphragm is always caused to be straightly extendingly and contractingly deformed in the axial direction of a device body casing, whereby the response property of the opening and closing operations of the air supply and discharge valves can be improved and the pulsation suppressing performance can be ensured.

32 Claims, 11 Drawing Sheets

PULSATION DAMPING DEVICE

BACKGROUND OF THE INVENTION

1. Field of the Invention

The present invention relates to a device that is interposingly used in a liquid transporting pipe through which transported liquid such as liquid for processing a semiconductor device is transported to various portions by a reciprocal pump, to damp pulsations generated by variations in flow quantity and pressure due to the reciprocal operation of the reciprocal pump.

2. Description of the Prior Art

A pulsation damping device of this kind is disclosed in, for example, Japanese Patent Application Laying-Open Nos. 617752 and 8-159016.

Among such disclosed devices, the pulsation damping device for a pump which is disclosed in Japanese Patent Application Laying-Open No. 6-17752 is shown in FIG. 11. The device comprises: a sealed device body casing 60; a liquid chamber 61*a* which is disposed in the device body casing 60, which temporarily stores liquid transported by a reciprocal pump to exert a liquid storage function, and which then allows the liquid to flow out; and an air chamber 61*b* which is disposed in the device body casing 60 and separated from the liquid chamber 61*a* via a pulsation suppression diaphragm 62 that is configured by an extendable and contractible bellows, and which is filled with compressed air. The device is configured so that the pulsation suppression diaphragm 62 is extended and contracted by pulsations due to the discharge pressure of the pump, and the pulsations are damped by the capacity change of the liquid chamber 61*a*.

In the case where the discharge pressure of the reciprocal pump is varied, the extension and contraction amount of the pulsation suppression diaphragm 62 must be restricted to a predetermined range in order to balance the liquid pressure in the liquid chamber 61*a* with the air pressure in the air chamber 61*b*. To comply with this, the following configuration is employed in the device shown in FIG. 11. An automatic air supply valve mechanism 63 and an automatic air discharge valve mechanism 64 are disposed in the device body casing 60. In the case where the pulsation suppression diaphragm 62 is extended from a reference value S in the direction of increasing the capacity of the liquid chamber by the liquid pressure variation in the liquid chamber 61*a*, when the diaphragm exceeds a predetermined range A, an air supply port 66 is opened by the pulsation suppression diaphragm 62 via a valve push rod 65 of the automatic air supply valve mechanism 63, to adjust the air filling pressure of the air chamber 61*b* so as to raise the pressure. In the case where the pulsation suppression diaphragm 62 is contracted from the reference value S in the direction of decreasing the capacity of the liquid chamber, when the diaphragm exceeds a predetermined range B, an air discharge port 68 is opened by the automatic air discharge valve mechanism 64 by means of a slider 67 which abuts against a closed end face 62*a* of the pulsation suppression diaphragm 62, to discharge the air in the air chamber 61*b* so as to lower the air filling pressure.

By contrast, FIG. 12A shows the pulsation damping device for a pump which is disclosed in Japanese Patent Application Laying-Open No. 8-159016, and FIG. 12B shows an air supply/discharge switch valve mechanism for the pump. The device uses an air chamber internal pressure adjust valve mechanism which restricts the capacity change of a liquid chamber 61*a* that is disposed in a similar manner as the liquid chamber 61*a* disclosed in Japanese Patent Application Laying-Open No. 6-17752, within a predetermined range. In the mechanism, the air supply/discharge switch valve mechanism comprising: an operating rod 69 which operates in accordance with the displacement of the closed end face 62*a* of the pulsation suppression diaphragm 62; and a slide valve element 71 which is operated by the operating rod 69 to cause an air supply and discharge passage 70 connected to the air chamber 61*b* to selectively communicate with the air supply port 66 and the air discharge port 68 is protrudingly attached to the outside of the device body casing 60. The valve mechanism is configured so that, when the capacity of the liquid chamber 61*a* is increased to exceed a predetermined range, the air supply port 66 communicates with the air supply and discharge passage 70, and, when the capacity of the liquid chamber 61*a* is decreased to exceed the predetermined range, the air discharge port 68 communicates with the air supply and discharge passage 70. The valve mechanism comprises: a cylindrical casing 72 in which the air supply port 66, the air discharge port 68, and the air supply and discharge passage 70 communicating with the air chamber 61*b* are formed; and the slide valve element 71 which is coaxially connected to the operating rod 69, and which is slidably fitted into a cylinder 73 housed in the cylindrical casing 72.

Among the above-mentioned two conventional art examples, in the former pulsation damping device disclosed in Japanese Patent Application Laying-Open No. 6-17752, as shown in FIG. 11, the automatic air supply valve mechanism 63 and the automatic air discharge valve mechanism 64 are disposed integrally with a lower end member 60*a* constituting a part of the device body casing 60. When one of the valve mechanisms 63 and 64 is broken or becomes faulty, therefore, the whole device must be disassembled and repaired, or replaced with another one. In any case, the work requires much labor. Therefore, the configuration is disadvantageous in maintenance and cost. Furthermore, the device has a structure in which the air discharge port 68 of the automatic air discharge valve mechanism 64 is closed by a gravitational drop of a discharge valve element 75. Therefore, the closing operation is unstable, and the device must be always placed so that the discharge valve element 75 in a vertical posture and the air discharge port 68 maintain their vertical positional relationship. For example, the device cannot be applied to a use in which the discharge valve element 75 has a horizontal posture, and hence the kinds of devices are restricted. Moreover, the valve push rod 65 of the automatic air supply valve mechanism 63, and the slider 67 of the automatic air discharge valve mechanism 64 which are independently juxtaposed are in direct contact at two points with the closed end face 62*a* of the pulsation suppression diaphragm 62 configured by the bellows. One of the members, or the valve push rod 65 is in direct contact with a position which is deviated from the center portion of the closed end face 62*a*. When the pulsation suppression diaphragm 62 is extended and contracted, therefore, an offset load is applied to the diaphragm, thereby hindering the extendable and contractible portion of the pulsation suppression diaphragm 62 from being straightly deformed extendingly and contractingly in the axial direction X—X of the device body casing 60. This impairs the response property of the automatic air supply and discharge valve mechanisms 63 and 64, thereby causing the pulsation suppressing performance to be lowered.

In the air supply/discharge switch valve mechanism disclosed in the latter publication or Japanese Patent Application Laying-Open No. 8-159016, the configuration in which suction and discharge of air are concentrated into the single valve mechanism as shown in FIGS. 12A and 12B is employed. Even when the valve mechanism is broken or becomes faulty, therefore, it is not required to disassemble the whole device, and repair and replacement can be performed by detaching only the single air supply/discharge switch valve mechanism. Unlike the former device, the closing of the air supply and discharge ports 66 and 68 is not performed by the weight of the discharge valve element 75. Therefore, the problem of the former device can be solved. By contrast, however, the device has drawbacks that the air supply/discharge switch valve mechanism itself is complicatedly structured, that it is difficult to seal the slide valve element 71, and that the mechanism protrudes to the outside of the device body casing 60 to increase the size of the whole device, thereby making the device bulky.

SUMMARY OF THE INVENTION

The invention has been conducted in view of the above-discussed problems. It is an object of the invention to provide a pulsation damping device which can be placed and used in either of the vertical and horizontal directions, and which can be configured in a wide variety of kinds.

It is another object of the invention to provide a pulsation damping device in which maintenance of air supply and discharge valves can be easily conducted, and an air supply/discharge valve structure wherein the air supply valve and the air discharge valve are separately and independently juxtaposed is employed so that the valve structure can be more simplified, the fault frequency can be made lower, and the device can be produced more economically than the above-mentioned air supply/discharge switch valve mechanism.

It is a further object of the invention to provide a pulsation damping device in which an offset load on a pulsation suppression diaphragm configured by a bellows is eliminated while an air supply valve and an air discharge valve are separately and independently juxtaposed, and an extendable and contractible portion of the pulsation suppression diaphragm is always caused to be straightly deformed extendingly and contractingly in the axial direction of a device body casing, whereby the response property of the opening and closing operations of the air supply and discharge valves can be improved and the pulsation suppressing performance can be ensured.

The pulsation damping device of the invention will be described with reference to the accompanying drawings. The reference numerals in the figures are used in this paragraph in order to facilitate the understanding of the invention, and the use of the reference numerals is not intended to restrict the contents of the invention to the illustrated embodiments.

The invention provides a pulsation damping device comprising: a sealed device body casing 17 having a liquid chamber 20*a* which receives liquid to be transported by a reciprocal pump or the like through an inflow passage 2, which temporarily stores the liquid, and which then allows the liquid to flow out through an outflow passage 3, and an air chamber 20*b* which is to be filled with compressed air for suppressing pulsation; and a pulsation suppression diaphragm 18 which is disposed in the device body casing to separate the liquid chamber 20*a* and the air chamber 20*b* from each other, and which is freely extended and contracted in accordance with a balance between variations in flow quantity and pressure of the transported liquid flowing into the liquid chamber, and an air filling pressure of the air chamber, wherein the pulsation damping device includes: a valve casing 23 which is placed in the air chamber 20*b* to be opposed to a center portion of a closed end face of the pulsation suppression diaphragm 18, the closed end face facing the air chamber 20*b*, and which has an air supply port 31 through which, when the air filling pressure of the air chamber is to be raised, the compressed air is introduced into the air chamber, and an air discharge port 32 through which, when the air filling pressure of the air chamber is to be lowered, the compressed air is discharged from the air chamber to an outside; an air supply valve 36 which is disposed in the valve casing, and which opens and closes the air supply port 31; a spring 37 which always closingly urges the air supply valve; an air discharge valve 43 which is disposed in the valve casing 23 to be juxtaposed with the air supply valve 36, and which opens and closes the air discharge port 32; a spring 49 which always closingly urges the air discharge valve; an air supply/discharge valve control plate 28 which is placed to abut against the center portion of the closed end face of the pulsation suppression diaphragm 18; an air supply valve rod pressing portion 55 which is disposed on the air supply/discharge valve control plate, and which pushes a rear end portion of a valve rod 41 of the air supply valve 36 to open the air supply valve, in accordance with that the liquid pressure of the liquid chamber is raised to overcome the air pressure of the air chamber and the pulsation suppression diaphragm 18 is extended; an air discharge valve rod pulling portion 56 which is juxtaposed with the air supply valve rod pressing portion on the air supply/discharge valve control plate 28, which is slidably connected to a rear end portion of a valve rod 45 of the air discharge valve 43, and which pulls the valve rod 45 to open the air discharge valve 43, in accordance with that the liquid pressure of the liquid chamber is lowered, the air pressure of the air chamber overcomes the liquid pressure of the liquid chamber, and the pulsation suppression diaphragm 18 is contracted; and springs 57 which are interposed between the valve casing 23 and the air supply/discharge valve control plate 28 to respectively surround outer peripheries of the air supply valve rod 41 and the air discharge valve rod 45, and which pressingly urge the air supply/discharge valve control plate 28 toward the center portion of the closed end face of the pulsation suppression diaphragm 18.

In this case, the valve casing 23 and the air supply/discharge valve control plate 28 may be connected to each other by one, or more preferably plural guide shafts 58 which are parallel to extending and contracting directions of the pulsation suppression diaphragm 18, and the air supply/discharge valve control plate 28 may be moved in parallel along the guide shafts.

In the thus configured pulsation damping device, in accordance with that the liquid pressure of the liquid chamber 20*a* is raised to overcome the air pressure of the air chamber 20*b* and the pulsation suppression diaphragm 18 is extended, the air supply valve rod pressing-portion 55 on the air supply/discharge valve control plate 28 pushes the rear end portion of the air supply valve rod 41 to open the air supply valve 36, thereby supplying the air into the air chamber 20*b*. When the liquid pressure of the liquid chamber 20*a* balances with the air pressure of the air chamber as a result of the above operation, the pulsation suppression diaphragm 18 is contracted, and the air supply valve 36 is closed by the forces of the spring 37 and the air pressure.

In accordance with that the liquid pressure of the liquid chamber 20*a* is lowered, the air pressure of the air chamber 20*b* overcomes the liquid pressure of the liquid chamber, and the pulsation suppression diaphragm 18 is contracted, the air discharge valve rod pulling portion 56 on the air supply/discharge valve control plate 28 pulls the air discharge valve rod 45 to open the air discharge valve 43, thereby discharging the air in the air chamber 20*b*. When the liquid pressure of the liquid chamber 20*a* balances with the air pressure of the air chamber 20*b* as a result of the above operation, the pulsation suppression diaphragm 18 is extended, and the air discharge valve 43 is closed by the forces of the air pressure and the spring 49. Irrespective of variations of the discharge pressure of a reciprocal pump or the like which transports the transported liquid to the liquid chamber 20*a,* therefore, the extension and contraction amount of the pulsation suppression diaphragm 18 can be restricted within a predetermined range, and the pulsation amplitude can be suppressed to a low level.

Since the air supply and discharge valves 36 and 43 are respectively closingly urged by the functions of the springs 37 and 49, the air supply port 31 and the air discharge port 32 can be closed stably and surely. Even when the device is placed and used in any of the vertical and horizontal directions so that the air supply valve 36 and the air discharge valve 43 have a vertical or horizontal posture, the opening and closing operations of the air supply port 31 and the air discharge port 32 are not hindered.

Although the air supply valve 36 and the air discharge valve 43 are independently juxtaposed in the valve casing 23, the air supply valve rod pressing portion 55 for opening the air supply valve 36, and the air discharge valve rod pulling portion 56 for opening the air discharge valve 43 abut against the center portion of the closed end face of the pulsation suppression diaphragm 18 via the air supply/discharge valve control plate 28. In extension and contraction of the pulsation suppression diaphragm 18, therefore, an offset load is eliminated, so that the extendable and contractible portion of the pulsation suppression diaphragm 18 is always straightly deformed extendingly and contractingly in the axial direction of the device body casing 17. Consequently, the response property of the opening and closing operations of the air supply and discharge valves 36 and 43 is improved and the pulsation suppressing performance can be ensured.

In this case, when the valve casing 23 and the air supply/discharge valve control plate 28 are connected to each other by one, or more preferably plural guide shafts 58 which are parallel to extending and contracting directions of the pulsation suppression diaphragm 18, the air supply/discharge valve control plate 28 can be always surely moved in parallel, and the operations in which the extendable and contractible portion of the pulsation suppression diaphragm 18 is always straightly deformed extendingly and contractingly in the axial direction of the device body casing 17 can be further ensured.

In another pulsation damping device of the invention, the valve casing 23 is detachably fittingly attached to the device body casing 17. According to this configuration, when one of the air supply valve 36 and the air discharge valve 43 is broken or becomes faulty, repair and replacement of the valve can be easily performed by detaching only the valve casing 23 from the device body casing 17. This is advantageous in maintenance. Furthermore, the air supply valve 36 and the air discharge valve 43 are separately and independently disposed in the single valve casing 23. Therefore, the valve structure is simple, becomes less faulty, and can be economically produced, and the valve casing 23 can be compactly accommodated without substantially protruding to the outside of the device body casing 17.

In a further pulsation damping device of the invention, an air driven reciprocal pump portion 4 is integrally attached to the device body casing 17, the reciprocal pump portion 4 comprises: a pump casing 6 which is disposed integrally with one side portion of the device body casing 17; a pump diaphragm 7 which is disposed in the pump casing 6 to be opposed to the pulsation suppression diaphragm 18, and which is extendingly and contractingly deformable in the extending and contracting directions of the pulsation suppression diaphragm 18; an air cylinder portion 14 which drives the pump diaphragm 7 to extend and contract the diaphragm; and a pump working chamber 9*a* in which check valves 16*a* and 16*b* are disposed inside the pump diaphragm 7, the check valves being alternately opened and closed in accordance with extending and contracting deformation of the pump diaphragm to perform actions of sucking and discharging the liquid, and the transported liquid which is discharged from the pump working chamber 9*a* via the discharge check valve 16*b* is temporarily sent into the liquid chamber 20*a*.

In the thus configured pulsation damping device, when the pump diaphragm 7 is extendingly and contractingly deformed via the air cylinder portion 14, the suction check valve 16*a* and the discharge check valve 16*b* in the pump working chamber 9*a* are alternately opened and closed, and suction of the transported liquid from the inflow passage 2 into the pump working chamber 9*a,* and discharge of the transported liquid from the pump working chamber 9*a* to the outflow passage 3 are repeated to perform a predetermined pumping function. At this time, the transported liquid which is discharged from the pump working chamber 9*a* via the discharge check valve 16*b* flows out into the outflow passage 3 through the liquid chamber 20*a* of the pulsation damping device 5. In this case, in a peak portion of pulsations of the discharge pressure of the discharged liquid, the pulsation suppression diaphragm 18 is moved in the direction along which the capacity of the liquid chamber is increased to absorb the pressure, and, in a valley portion of the pulsations, the pulsation suppression diaphragm 18 is moved in the direction along which the capacity of the liquid chamber is decreased to raise the pressure of the discharged liquid, thereby absorbing pulsations. As a result, the transported liquid can be flown out continuously and smoothly without producing pulsations. Since the reciprocal pump portion 4 and the pulsation damping device 5 are integrated with each other and external pipes connecting them are not required, the cost and the size of the whole can be reduced, and the installation space can be largely decreased. Since external pipes are not used, there is no fear that liquid leakage due to breakage of the pipes or the like occurs after a long term use. Since the pressure loss is very small, the pump capacity can be made small so that the pump itself can be miniaturized and the installation and occupation area of the pump can be decreased.

In a still further pulsation damping device of the invention, in the air discharge valve rod pulling portion 56, a sleeve 48 which has a guide hole portion 48*a* in a front end portion is disposed on the air supply/discharge valve control plate 28 to be juxtaposed with the air supply valve rod pressing portion 55, and a rear end portion of the air discharge valve rod 45 is slidably passed through the guide hole portion 48*a* of the sleeve 48 so as to be prevented from slipping off, the rear end portion having a flange 44. According to this configuration, the air discharge valve 43 can be surely pulled and opened in accordance with the movement of the air supply/discharge valve control plate 28 which is moved followingly with the contracting operation of the pulsation suppression diaphragm 18.

In a still further pulsation damping device of the invention, in the air discharge valve rod 45, a root portion with respect to the air discharge valve 43 is slidably passed through a valve rod guide hole portion 47*a* of an air discharge valve rod holder 47 which is disposed in the valve casing 23. According to this configuration, the linear movement guidance of the air discharge valve rod 45 can be surely performed.

In a still further pulsation damping device of the invention, the air supply valve rod 41 is slidably passed through a valve rod pass hole 39 of an air supply valve holder 40 which is disposed in the valve casing 23, the valve rod pass hole 39 being formed in a rear end portion of the air supply valve holder, and a rear end portion of the air supply valve rod 41 protrudes toward a rear side of the air supply valve holder 40. According to this configuration, the linear movement guidance of the air supply valve rod 41 can be surely performed.

In a still further pulsation damping device of the invention, a front end portion of each of the guide shafts 58 is coupled integrally with the valve casing 23, and a rear end portion of the guide shaft 58 is slidably passed through a guide sleeve 22 fixed to the air supply/discharge valve control plate 28 so as to be prevented from slipping off, the rear end portion having a flange 58*a*. According to this configuration, the air supply/discharge valve control plate 28 can be moved in parallel stably and surely

DETAILED DESCRIPTION OF THE PREFERRED EMBODIMENTS

An embodiment of the pulsation damping device of the invention will be described with reference to FIGS. 1 to 9.

Figure 1:
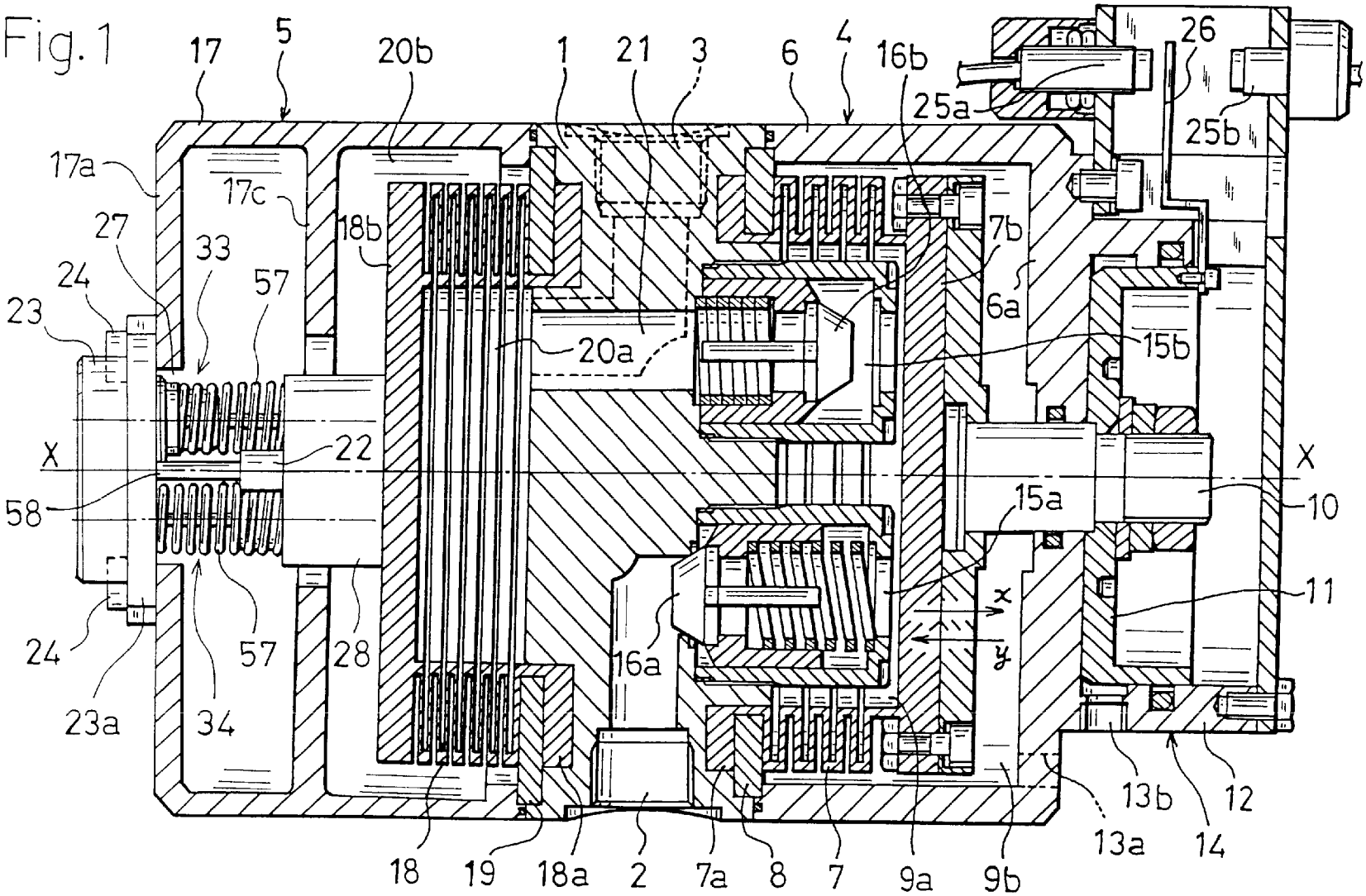
FIG. 1 is a longitudinal sectional front view of the whole of a pulsation damping device which is an embodiment of the invention.

FIG. 1 is a longitudinal sectional front view of the whole of a pulsation damping device which is applied to an air driven bellows pump for a semiconductor manufacturing apparatus. In FIG. 1, 1 denotes a partition wall of the device body in which an inflow passage 2 and an outflow passage 3 for liquid transported by the pump are formed. A reciprocal pump portion 4 and a pulsation damping device 5 are integrally disposed on both the sides of the partition wall 1 so as to be opposed to each other, respectively.

A bottomed cylindrical pump casing 6 is formed continuously with one side portion of the partition wall 1. A bottomed cylindrical pump diaphragm 7 configured by a bellows or a diaphragm which is extendingly and contractingly deformable in the axial direction X—X of the pump casing 6 is disposed in the pump casing 6 (in the illustrated example, the diaphragm is configured by a bellows). An opening peripheral edge 7*a* of the pump diaphragm 7 is airtightly pressingly fixed to one side face of the partition wall 1 by an annular fixing plate 8. According to this configuration, the inner space of the pump casing 6 is hermetically partitioned into a pump working chamber 9*a* inside the pump diaphragm 7, and a pump operating chamber 9*b* outside the pump diaphragm 7.

A cylinder body 12 in which a piston body 11 that is fixedly coupled via a coupling member 10 to a closed end member 7*b* of the pump diaphragm 7 is slidably housed is fixed to the outside of a bottom wall portion 6*a* of the pump casing 6. Pressurized air which is fed from a pressurized air supplying device (not shown) such as a compressor is supplied to the interior of the cylinder body 12, or the pump operating chamber 9*b* via air holes 13*a* and 13*b* formed in the cylinder body 12 and the bottom wall portion 6*a* of the pump casing 6, thereby configuring an air cylinder portion 14 which drives the pump diaphragm 7 so as to extend and contract. Proximity sensors 25*a* and 25*b* are attached to the air cylinder portion 14, and a sensor sensing plate 26 is attached to the piston body 11. In accordance with the reciprocal motion of the piston body 11, the sensor sensing plate 26 alternately approaches the proximity sensors 25*a* and 25*b*, whereby the supply of the pressurized air which is fed from the pressurized air supplying device (not shown), into the cylinder body 12, and that into the pump operating chamber 9*b* are automatically switched over.

A suction port 15*a* and a discharge port 15*b* which are opened in the pump working chamber 9*a* communicate with the inflow passage 2 and the outflow passage 3, respectively. A suction check valve 16*a* and a discharge check valve 16*b* which are alternately opened and closed in accordance with extending and contracting operations of the pump diaphragm 7 are disposed in the suction port 15*a* and the discharge port 15*b*, respectively. The above-mentioned components constitute the reciprocal pump portion 4.

On the other hand, a bottomed cylindrical device body casing 17 is disposed in the other side portion of the partition wall 1 so as to be coaxial with the pump casing 6. In the device body casing 17 also, a bottomed cylindrical pulsation suppression diaphragm 18 configured by a bellows or a diaphragm which is extendingly and contractingly deformable in the axial direction X—X of the device body casing 17 is disposed so as to be opposed to the pump diaphragm 7 in the pump portion 4 (in the illustrated example, the diaphragm is configured by a bellows). An opening peripheral edge 18*a* of the pulsation suppression diaphragm 18 is airtightly pressingly fixed to the other side face of the pertition wall 1 by an annular fixing plate 19. According to this configuration, the inner space of the device body casing 17 is partitioned into a liquid chamber 20*a* which is formed inside the pulsation suppression diaphragm 18, and which temporarily stores the liquid that is to be discharged via the discharge check valve 16*b* in the pump portion 4 and a communication passage 21 formed in the thickened portion of the partition wall 1, and an air chamber 20*b* which is formed outside the pulsation suppression diaphragm 18, and which is to be filled with compressed air for suppressing pulsation.

The above-mentioned components constitute the pulsation damping device 5 which causes pulsation due to the discharge pressure of the liquid discharged from the pump working chamber 9*a* of the pump portion 4, to be absorbed and damped by a change in the capacity of the liquid chamber 20*a* due to extending and contracting deformation of the pulsation suppression diaphragm 18.

An automatic pressure adjusting mechanism configured by an automatic air supply valve mechanism 33 and an automatic air discharge valve mechanism 34 is disposed in the air chamber 20*b* of the pulsation damping device 5.

In the automatic pressure adjusting mechanism, an opening 27 is formed in the vicinity of the center of an air chamber closing wall 17*a* of the device body casing 17. A valve casing 23 in which air supply and discharge valves are incorporated is fitted into the opening 27. A flange 23*a* attached to the outer periphery of the rear end of the valve casing 23 is detachably fastened to the bottom wall 17*a* by bolts 24 or the like. By contrast, an air supply/discharge valve control plate 28 is placed so as to abut against a center portion of a closed end face 18*b* of the pulsation suppression diaphragm 18 facing the air chamber 20*b* of the pulsation suppression diaphragm 18, so as to be opposed to the valve casing 23.

Figure 2:
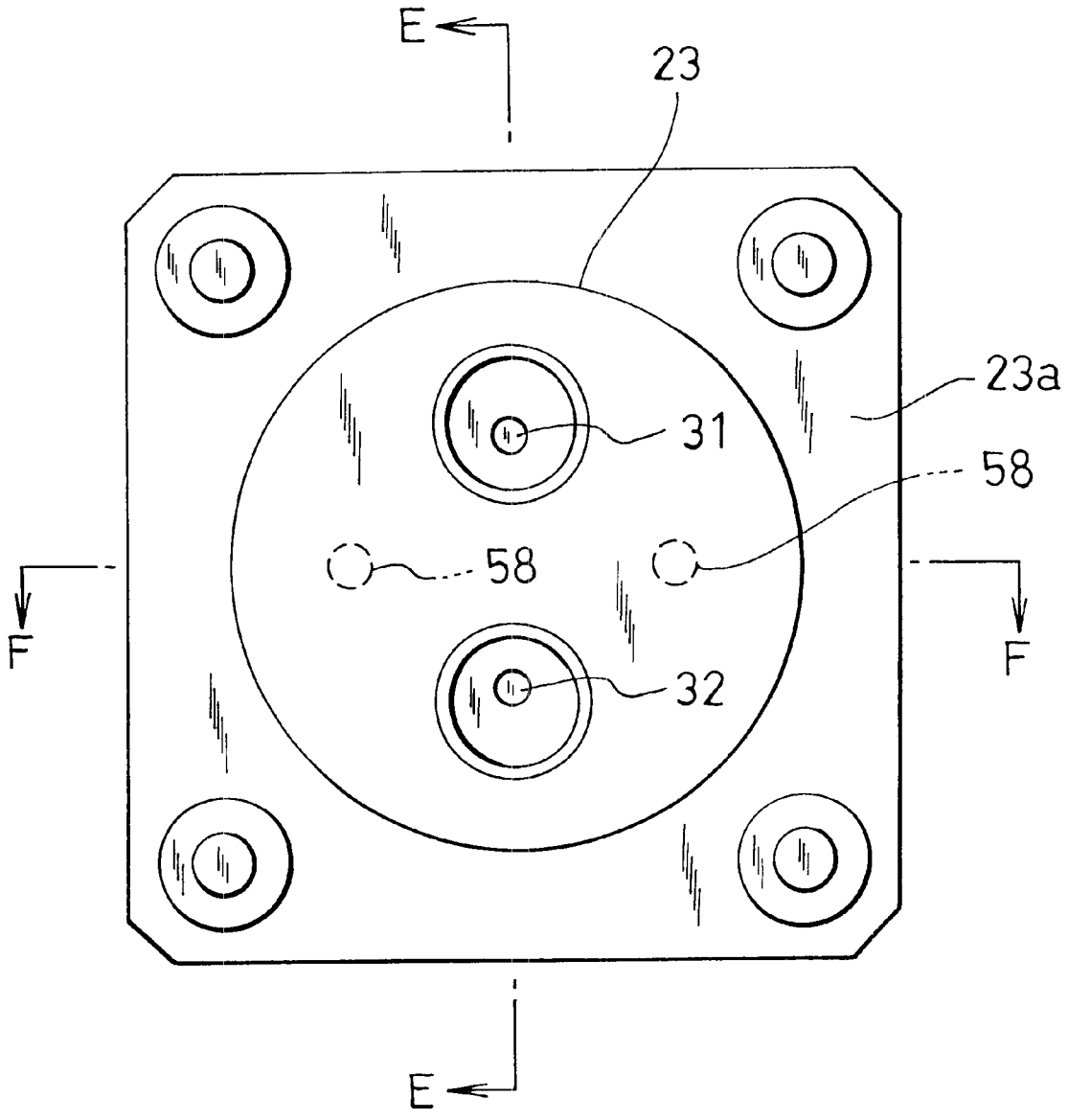
FIG. 2 is a front view of an automatic air supply valve mechanism of the pulsation damping device of FIG. 1.
Figure 3:
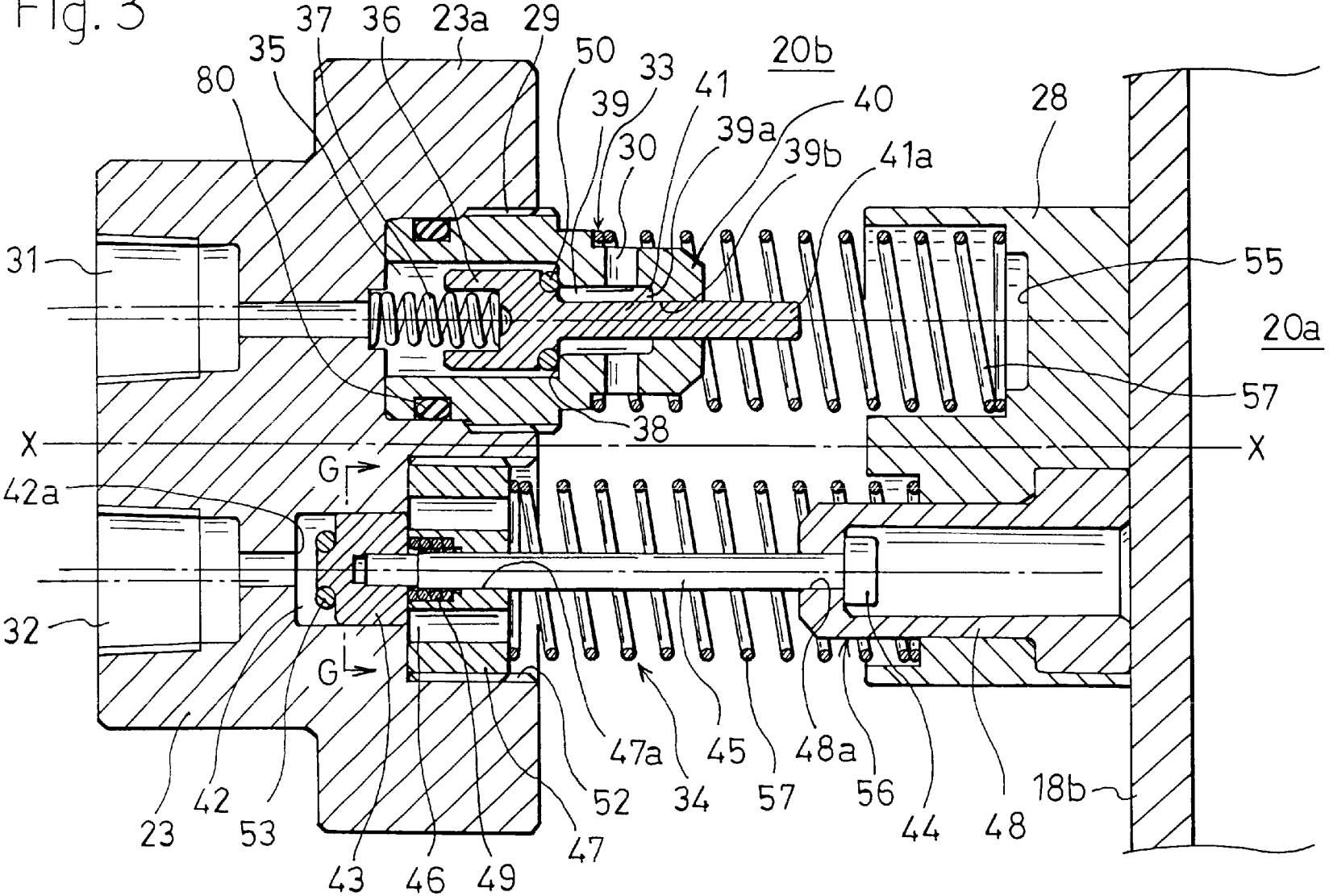
FIG. 3 is a section view taken along the line E—E of FIG. 2.

As shown in FIGS. 2 and 3, an air supply port 31 and an air discharge port 32 are formed in the front end face of the valve casing 23 so as to be juxtaposed. The automatic air supply valve mechanism 33 is disposed in the air supply port 31. When the capacity of the liquid chamber 20*a* is increased to exceed a predetermined range, the air supply valve mechanism supplies air of a pressure which is equal to or higher than the maximum pressure of the transported liquid, into the air chamber 20*b*, thereby raising the filling pressure in the air chamber 20*b*. The automatic air discharge valve mechanism 34 is disposed in the air discharge port 32. When the capacity of the liquid chamber 20*a* is decreased to exceed the predetermined range, the automatic air discharge valve mechanism 34 discharges air from the air chamber 20*b* to lower the filling pressure in the air chamber 20*b*.

In the automatic air supply valve mechanism 33, as shown in FIG. 3, an internal thread hole 29 is formed in the rear end face of the valve casing 23 so as to communicate with the air supply port 31, and an air supply valve holder 40 which holds an air supply valve 36 and a valve rod 41 integrated therewith is screwingly fixed to the internal thread hole 29 via an O-ring 80. In the air supply valve holder 40, an air supply valve chamber 35 is formed in a front end portion which is screwed into the internal thread hole 29, a valve seat 38 is formed on the inner bottom of the air supply valve chamber 35, and a valve rod pass hole 39 is formed in a rear end portion so as to communicate with the air supply valve chamber 35 in the same axis. A plurality of communication holes 30 which enable the air supply valve chamber 35 and the air chamber 20*b* to communicate with each other via the valve rod pass hole 39 are formed in the outer periphery of the rear end portion of the air supply valve holder 40. This formation of the communication holes 30 can improve the response property of the air chamber 20*b* with respect to a pressure change.

In the air supply valve holder 40, the air supply valve 36 is incorporated into the air supply valve chamber 35 so as to be movable along the axial direction, and the valve rod 41 is passed through the valve rod pass hole 39. A rear end portion of the valve rod 41 protrudes toward the rear side of the air supply valve holder 40. The valve rod pass hole 39 is formed into a stepped shape having a larger diameter portion 39*a* which has an inner diameter that is larger than the outer diameter of the valve rod 41 to form a communication gap between the portion and the valve rod 41, and a guide hole portion 39*b* which is slightly larger than the outer diameter of the valve rod 41 so as to be in sliding contact with the valve rod 41 without leaving a substantial gap therebetween. The valve rod 41 of the air supply valve 36 is slidingly guided by the guide hole portion 39*b*, thereby enabling the air supply valve 36 to be straightly moved in the air supply valve chamber 35 in the axial direction.

Figure 5:
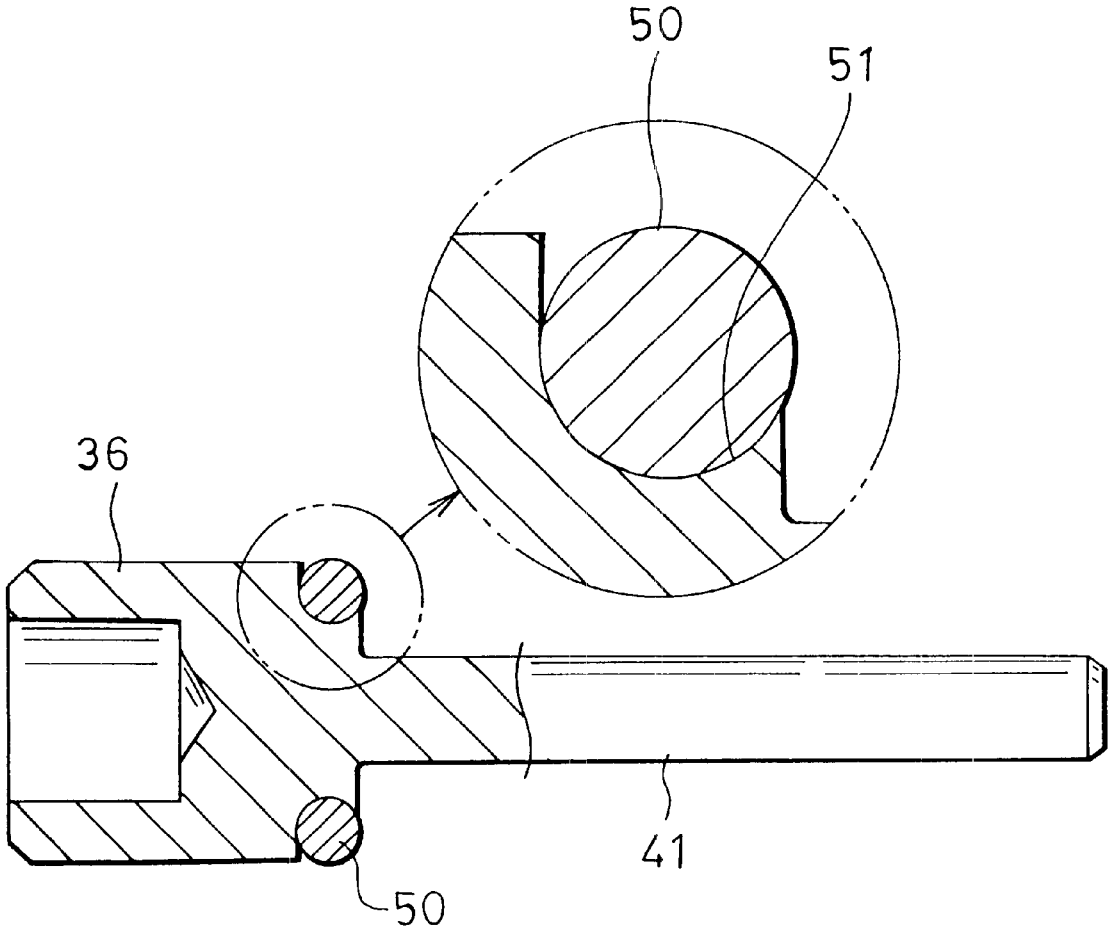
FIG. 5 is a section view of an air supply valve of the automatic air supply valve mechanism of the pulsation damping device of FIG. 1.

In the air supply valve chamber 35, the air supply valve 36 is always urged by a spring 37 so as to be in the closing position where the valve is closely in contact with the valve seat 38. The air supply valve 36 is airtightly in contact with the valve seat 38 via an O-ring 50. As shown in FIG. 5, the O-ring 50 is attached to the air supply valve 36 so as to be prevented from slipping off, with being fitted into an arcuate groove 51 which is formed in an edge portion of the rear end face of the valve.

Under the condition where the pulsation suppression diaphragm 18 is in a reference position in a mean pressure state of the liquid pressure in the liquid chamber 20*a*, the air supply valve element 36 is in close contact with the valve seat 38 of the valve rod holder 40 to close the air supply port 31, and an end portion 41*a* of the valve rod 41 which faces the air chamber 20*b* is separated from the closed end face 18*b* of the pulsation suppression diaphragm 18 by a predetermined stroke.

Figure 6:
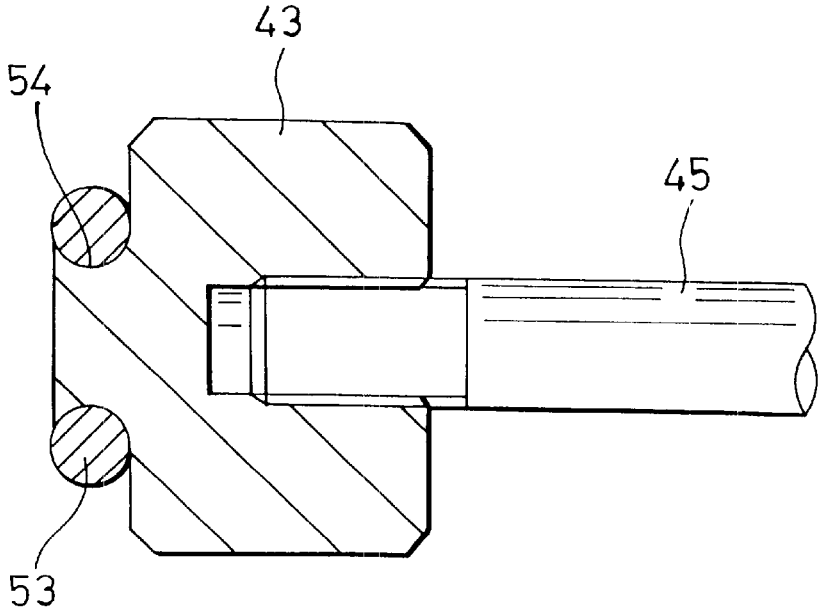
FIG. 6 is a section view of an air discharge valve of the automatic air supply valve mechanism of the pulsation damping device of FIG. 1.
Figure 7:
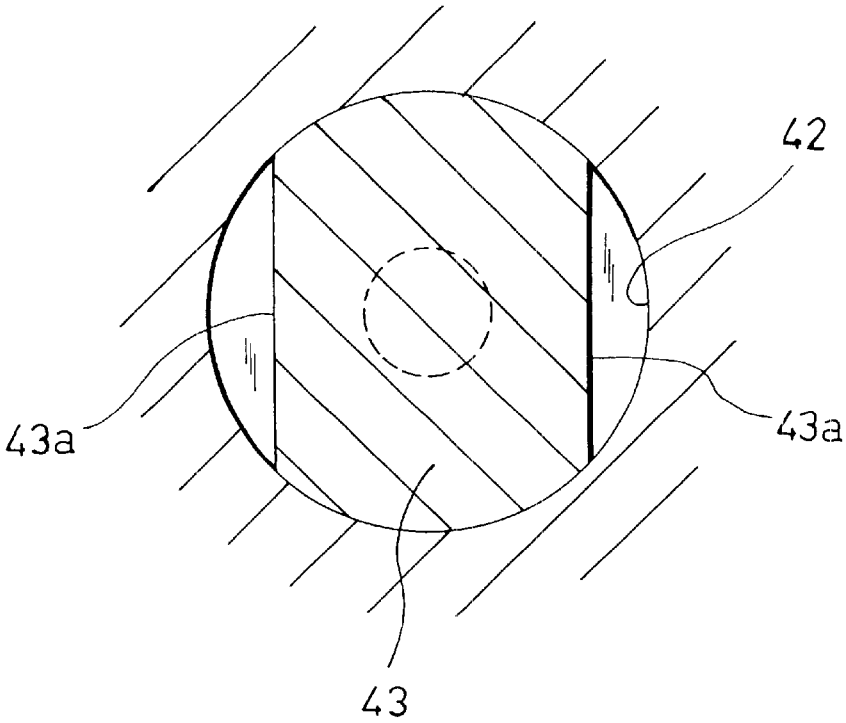
FIG. 7 is a section view taken along the line G—G of FIG. 3.

In the automatic air discharge valve mechanism 34, as shown in FIG. 3, an air discharge valve chamber 42 having a circular section, and an internal thread portion 52 having an inner diameter which is larger than the inner diameter of the air discharge valve chamber 42 are formed on the rear end face of the valve casing 23 so as to communicate with the air discharge port 32 in the same axis. An air discharge valve 43 having a shape in which flat faces 43*a* are formed in opposing portions on the circumference as shown in FIG. 7 is incorporated into the air discharge valve chamber 42 so as to be movable in the axial direction. An air discharge valve rod 45 is integrally coupled with the air discharge valve 43. The air discharge valve rod 45 is passed through and held by a valve rod guide hole portion 47*a* at the center of an air discharge valve rod holder 47 which is screwingly fixed to the internal thread portion 52, so as to be slidable in the axial direction. In the air discharge valve rod holder 47, a plurality of communication holes 46 through which the air discharge valve chamber 42 and the air chamber 20*b* communicate with each other are formed on the same circle centered at the valve rod guide hole portion 47*a*. A spring 49 through which the discharge valve rod 45 is passed is interposed between the air discharge valve 43 and the air discharge valve rod holder 47. The air discharge valve 43 is always urged by the spring 49 so as to be in the closing position where the valve is closely in contact with a valve seat 42*a* of the air discharge valve chamber 42. The air discharge valve 43 is airtightly in contact with the valve seat 42*a* via an O-ring 53. As shown in FIG. 6, the O-ring 53 is attached to the air discharge valve 43 so as to be prevented from slipping off, with being fitted into an arcuate groove 54 which is formed in an edge portion of the front end face of the valve.

Under the condition where the pulsation suppression diaphragm 18 is in the reference position, the air discharge valve 43 closes the air discharge port 32, and a flange 44 in the rear end of the air discharge valve rod 45 is separated from the inner face of the closed end face 48*a* of the slider 48 by a predetermined stroke.

On the other hand, the air supply/discharge valve control plate 28 which is placed so as to abut against the center portion of the closed end face 18*b* of the pulsation suppression diaphragm 18 is formed into a disk-like shape, an air supply valve rod pressing portion 55 is recessedly formed in the front face of the plate, and a sleeve 48 constituting an air discharge valve rod pulling portion 56 is fittingly fixed with being juxtaposed with the air supply valve rod pressing portion 55. A guide hole portion 48*a* which is slightly larger than the outer diameter of the air discharge valve rod 45 so as to be in sliding contact with the valve rod 45 without leaving a substantial gap therebetween. A rear end portion of the air discharge valve rod 45 and having the flange 44 is passed through and coupled to the guide hole portion 48*a* so as to be slidable and prevented from slipping off. The air discharge valve rod 45 is slidingly guided by the guide hole portion 48*a,* so as to be straightly movable in the axial direction. The sleeve 48 may be formed integrally with the air supply/discharge valve control plate 28.

Springs 57 each formed by a compression coil spring are interposed between the air supply valve rod pressing portion 55 of the air supply/discharge valve control plate 28 and the air supply valve holder 40, and between the sleeve 48 and the rear end face of the air discharge valve rod holder 47, so as to surround the outer peripheries of the air supply valve rod 41 and the air discharge valve rod 45. The air supply/discharge valve control plate 28 is pressingly urged by the springs 57 toward the center portion of the closed end face 18*b* of the pulsation suppression diaphragm 18.

Figure 4:
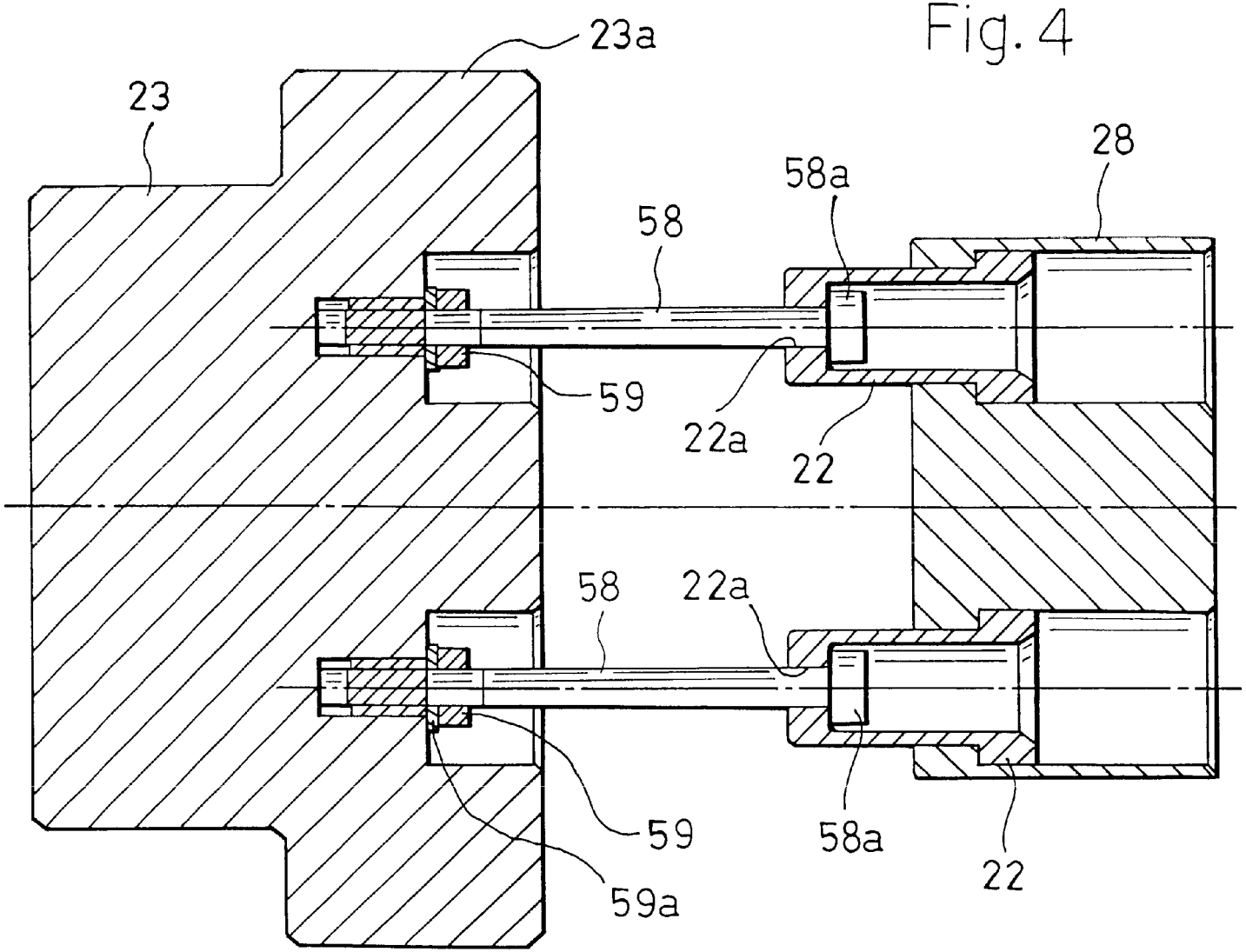
FIG. 4 is a section view taken along the line F—F of FIG. 2.

As shown in FIG. 4, the air supply/discharge valve control plate 28 and the valve casing 23 are connected to each other by one, or more preferably plural guide shafts 58 which are parallel to the extending and contracting directions of the pulsation suppression diaphragm 18. In each of the guide shafts 58, the front end portion is fasteningly fixed to the rear end face of the valve casing 23 by a nut 59 via a washer 59*a,* and the rear end portion having a flange 58*a* is passed through and coupled to a guide sleeve 22 which is embeddedly fixed to the front end face of the air supply/discharge valve control plate 28, so as to be prevented from slipping off and slidable in the axial direction. In the front end portion of each of the guide sleeves 22, a guide hole portion 22*a* which is slidingly contacted with the corresponding guide shaft 58 without leaving a substantial gap therebetween is formed. The rear end portions of the guide shafts 58 are passed through the guide hole portions 22*a,* thereby enabling the air supply/discharge valve control plate 28 to be straightly moved in parallel with the extending and contracting directions of the pulsation suppression diaphragm 18 under guidance of the guide shafts 58. The guide sleeves 22 may be formed integrally with the air supply/discharge valve control plate 28.

Next, the operation of the thus configured pulsation damping device for the pump will be described.

The pressurized air which is fed from the pressurized air supplying device (not shown) such as a compressor is supplied to the interior of the cylinder body 12 of the air cylinder portion 14 in the reciprocal pump portion 4, via the air hole 13*b,* to move the piston body 11 and the coupling member 10 in the direction x in FIG. 1, thereby extending the pump diaphragm 7 in the direction x in FIG. 1. The transported liquid in the inflow passage 2 is sucked into the pump working chamber 9*a* via the suction check valve 16*a*. When the pressurized air is supplied into the pump operating chamber 9*b* of the air cylinder portion 14 via the air hole 13*b* and air is discharged through the air hole 13*b* to cause the pump diaphragm 7 to be contracted in the direction y in FIG. 1, the transported liquid which has been sucked into the pump working chamber 9*a* is discharged via the discharge check valve 16*b*. When the pump diaphragm 7 of the reciprocal pump portion 4 is driven via the air cylinder portion 14 so as to be extended and contracted as described above, the suction check valve 16*a* and the discharge check valve 16*b* are alternately opened and closed, so that suction of the liquid from the inflow passage 2 into the pump working chamber 9*a,* and discharge of the liquid from the pump working chamber 9*a* into the outflow passage 3 are repeated to conduct a predetermined pumping action. When the transported liquid is fed to a predetermined portion by the operation of the reciprocal pump portion 4, the pump discharge pressure generates pulsations due to repetition of peak and valley portions.

The transported liquid discharged from the pump working chamber 9*a* of the pump portion 4 via the discharge check valve 16*b* is passed through the communication passage 21 and then sent into the liquid chamber 20*a* in the pulsation damping device 5. The liquid is temporarily stored in the liquid chamber 20*a,* and thereafter discharged into the outflow passage 3. When the discharge pressure of the transported liquid is in a peak portion of a discharge pressure curve, the transported liquid causes the pulsation suppression diaphragm 18 to be extended so as to increase the capacity of the liquid chamber 20*a,* and hence the pressure of the liquid is absorbed. At this time, the flow quantity of the transported liquid flowing out from the liquid chamber 20*a* is smaller than that of the liquid supplied from the reciprocal pump portion 4.

When the discharge pressure of the transported liquid comes to a valley portion of the discharge pressure curve, the pressure of the transported liquid becomes lower than the filling pressure of the air chamber 20*b* which is compressed by extension of the pulsation suppression diaphragm 18, and hence the pulsation suppression diaphragm 18 is contracted. At this time, the flow quantity of the liquid flowing out from the liquid chamber 20*a* is larger than that of the transported liquid flowing from the reciprocal pump portion 4 into the liquid chamber 20*a*. This repeated operation, i.e., the capacity change of the liquid chamber 20*a* causes the pulsation to be absorbed and suppressed.

Figure 8A:
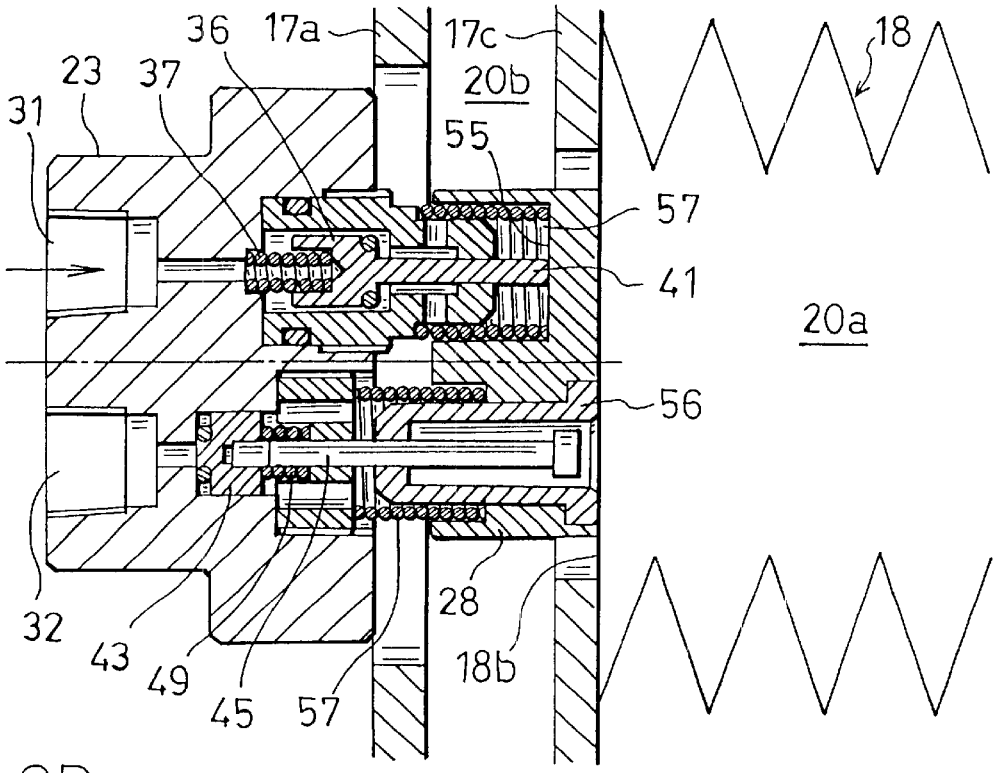
FIG. 8A is a view showing the operation of the automatic air supply valve mechanism when the liquid pressure in a pulsation suppression diaphragm of the pulsation damping device of FIG. 1 is raised.
Figure 8B:
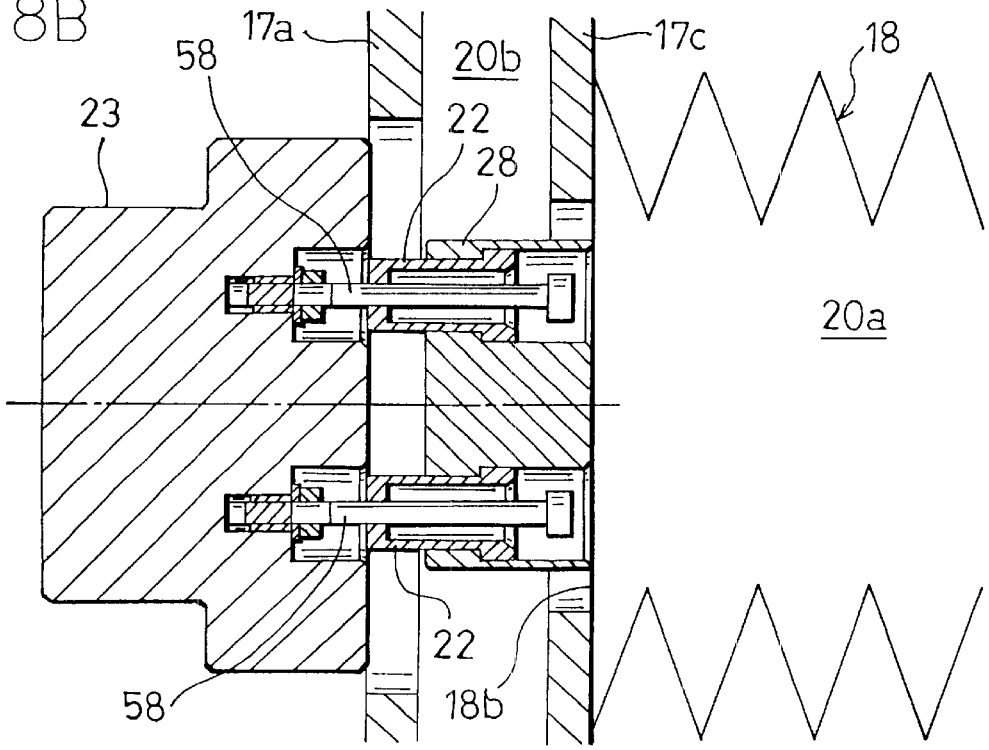
FIG. 8B is a view showing the operation of a guide shaft portion of an air supply/discharge valve control plate when the liquid pressure in the pulsation suppression diaphragm of the pulsation damping device of FIG. 1 is raised.

When the discharge pressure of the reciprocal pump portion 4 is varied in the increasing direction during such an operation, the capacity of the liquid chamber 20*a* is increased by the transported liquid, with the result that the liquid pressure of the liquid chamber 20*a* overcomes the pressure of the air chamber 20*b* and the pulsation suppression diaphragm 18 is extended. In accordance with the extension of the pulsation suppression diaphragm 18, as shown in FIGS. 8A and 8B, the air supply/discharge valve control plate 28 is pushed in the direction of the valve casing 23 by the center portion of the closed end face 18*b* of the pulsation suppression diaphragm 18. As a result, the air supply valve 36 which has been closed by the spring 37 is opened by pushing the rear end portion of the air supply valve rod 41 with the air supply valve rod pressing portion 55 of the air supply/discharge valve control plate 28, and the compressed air is supplied into the air chamber 20*b* through the air supply port 31, with the result that the filling pressure of the air chamber 20*b* is raised. In accordance with the rise of the filling pressure in the air chamber 20*b*, the pulsation suppression diaphragm 18 is contracted. Then, the air supply valve rod pressing portion 55 of the air supply/discharge valve control plate 28 does not push the rear end portion of the air supply valve rod 41, and the air supply valve 36 is set to the closing state by the spring 37 and the pressure of the compressed air in the air chamber 20*b*, so as to balance with the liquid pressure in the liquid chamber 20*a*. When the pulsation suppression diaphragm 18 is extended by a degree which is greater than the predetermined stroke, the closed end face 18*b* strikes against a stopper wall 17*c* of the device body casing 17 which protrudes into the air chamber 20*b*, whereby excessive extending deformation of the pulsation suppression diaphragm 18 is restricted, so that the diaphragm can be prevented from being damaged.

Figure 9A:
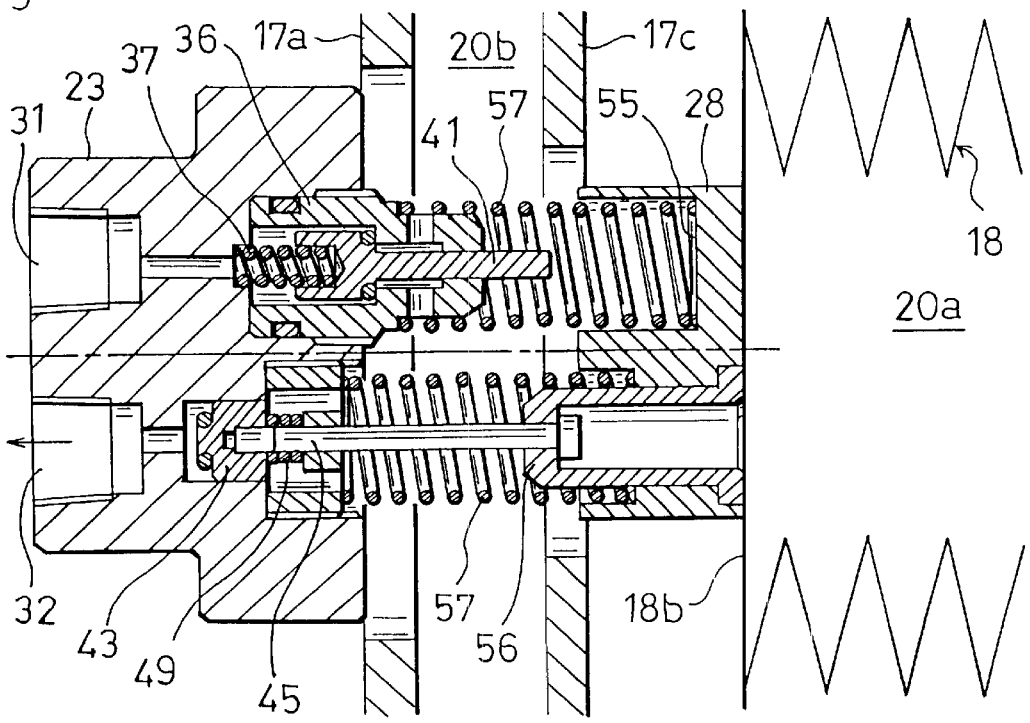
FIG. 9A is a view showing the operation of the automatic air supply valve mechanism when the liquid pressure in the pulsation suppression diaphragm of the pulsation damping device of FIG. 1 is lowered.
Figure 9B:
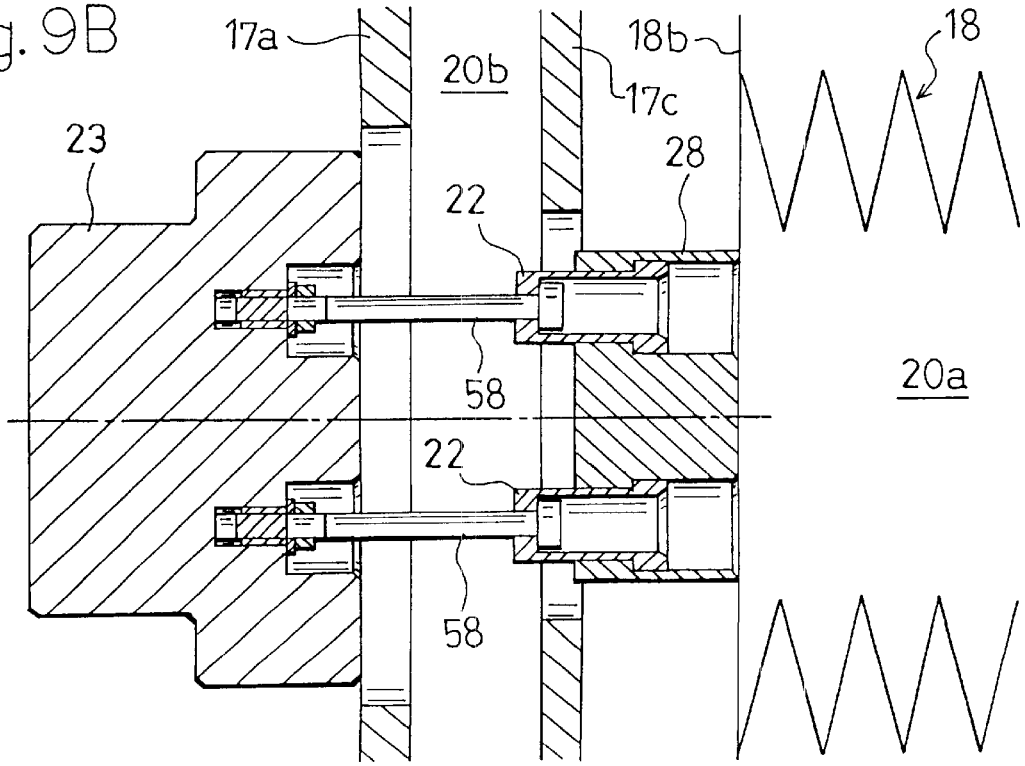
FIG. 9B is a view showing the operation of the guide shaft portion of the air supply/discharge valve control plate when the liquid pressure in the pulsation suppression diaphragm of the pulsation damping device of FIG. 1 is lowered.

By contrast, when the discharge pressure of the reciprocal pump portion 4 is lowered, the capacity of the liquid chamber 20*a* is reduced by the transported liquid, and the pressure in the air chamber 20*b* the liquid pressure in the liquid chamber 20*a*, so that the pulsation suppression diaphragm 18 is contractingly deformed. As shown in FIGS. 9A and 9B, this contracting deformation of the pulsation suppression diaphragm 18 causes the air supply/discharge valve control plate 28 to, in accordance with the movement of the closed end face 18*b* of the pulsation suppression diaphragm 18 in the contracting direction, be moved in the same direction while receiving the urging force of the springs 57. The air discharge valve rod 45 which is coupled to the discharge valve rod pulling portion 56 of the air supply/discharge valve control plate 28 is pulled in the same direction, whereby the discharge valve 43 is changed to the opening state. Therefore, the compressed air in the air chamber 20*b* is discharged to the atmosphere through the air discharge port 32 to lower the filling pressure in the air chamber 20*b*. In accordance with the reduction of the filling pressure in the air chamber 20*b*, the pulsation suppression diaphragm 18 is extended. Then, the air supply/discharge valve control plate 28 is pushed by the center portion of the closed end face 18*b* of the pulsation suppression diaphragm 18, and the air discharge valve 43 is caused to close the air discharge port 32 by the urging action of the spring 49. As a result, the filling pressure in the air chamber 20*b* is fixed to the adjusted state.

As described above, when a liquid pressure is applied to the pulsation suppression diaphragm 18, the compressed air is sucked or discharged until balance with the pressure is attained, whereby pulsations are efficiently absorbed and the amplitude of pulsations is suppressed to a low level, irrespective of variation of the discharge pressure of the pump working chamber 9*a* of the reciprocal pump portion 4.

In this way, the air supply valve 36 and the air discharge valve 43 which are separately and independently disposed in the valve casing 23 are subjected to the valve-opening control in accordance with extension and contraction of the pulsation suppression diaphragm 18, via the air supply valve rod pressing portion 55 and the air discharge valve rod pulling portion 56 on the air supply/discharge valve control plate 28. Since the air supply/discharge valve control plate 28 is placed so as to always abut against the center portion of the closed end face 18*b* of the pulsation suppression diaphragm 18, no offset load is applied to the pulsation suppression diaphragm 18 even when the air supply valve 36 and the air discharge valve 43 are juxtaposed separately and independently in the valve casing 23. Therefore, the pulsation suppression diaphragm 18 is always straightly extendingly and contractingly deformed in the axial direction X—X of the device body casing 17, whereby the response performance of the opening and closing operations of the air supply and discharge valves 36 and 43 can be improved and the performance of reducing pulsations can be ensured. The air supply/discharge valve control plate 28 can be always enabled to be moved in parallel stably and surely by the guiding action of the guide shafts 58. Consequently, the air supply and discharge valves 36 and 43 can faithfully perform the opening and closing operations corresponding to extension and contraction of the pulsation suppression diaphragm 18, via the air supply/discharge valve control plate 28.

Figure 10:
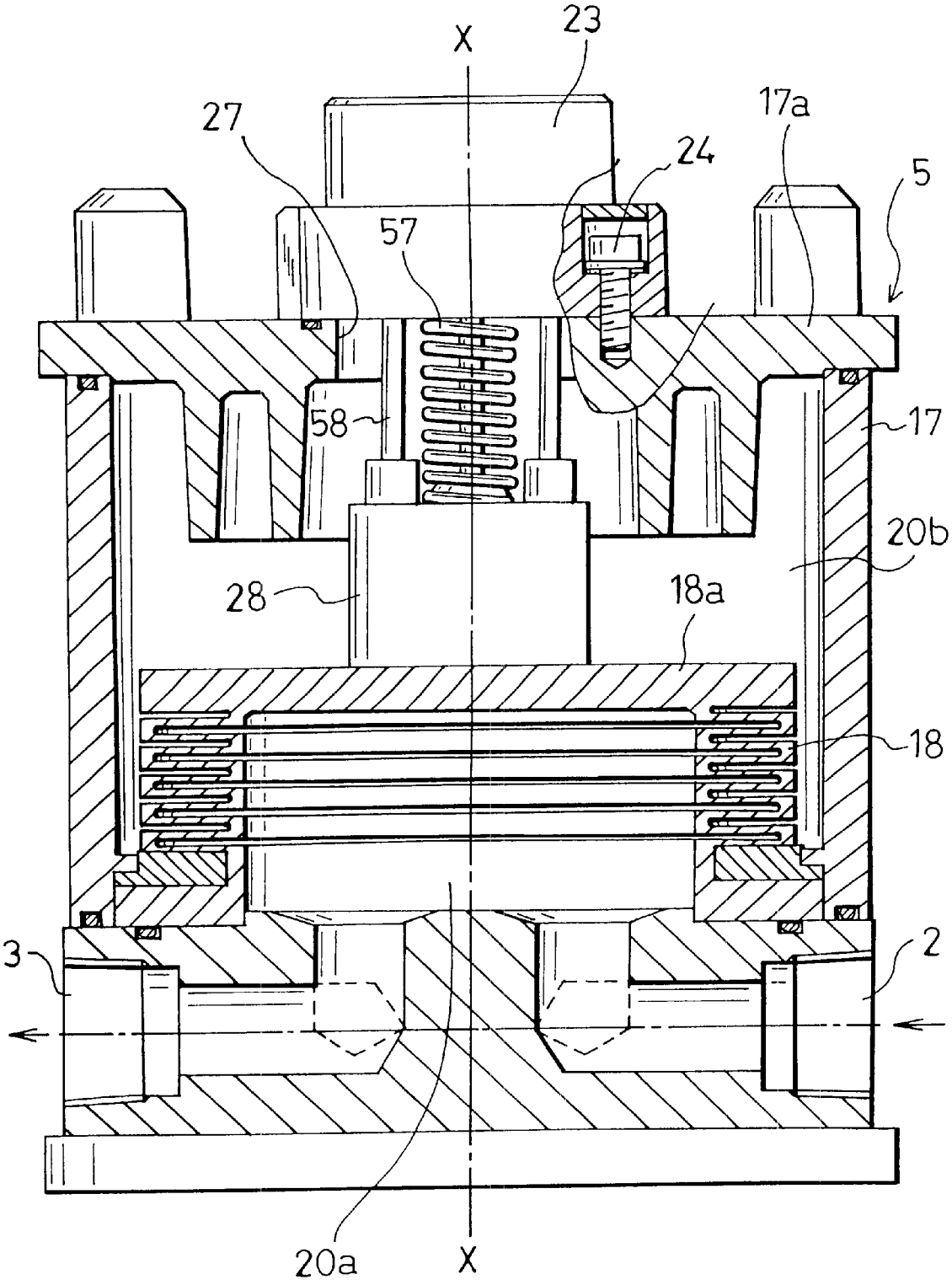
FIG. 10 is a longitudinal sectional front view of the whole of a pulsation damping device which is another embodiment of the invention.
Figure 11:
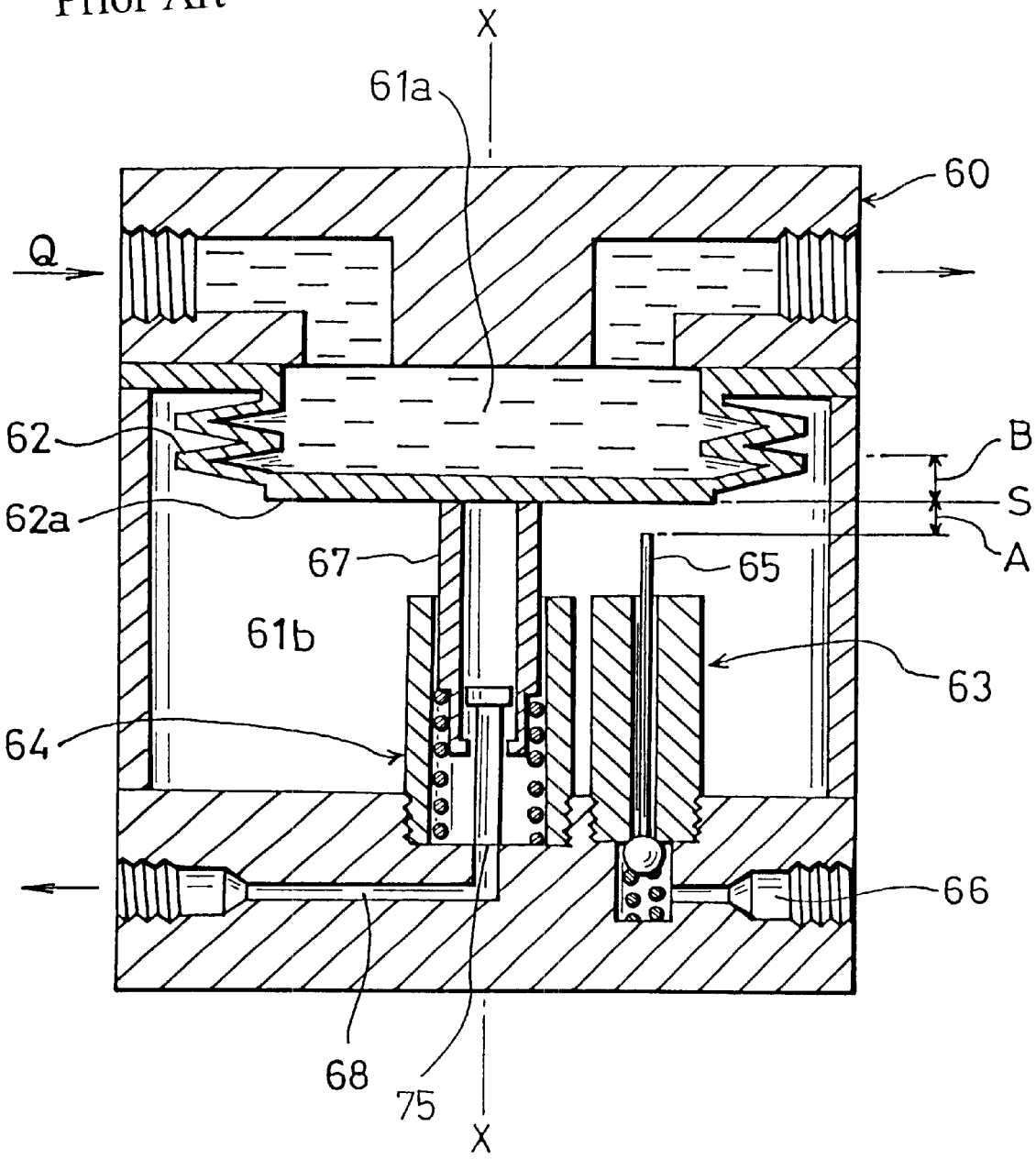
Fig. 11 Prior Art
FIG. 11 is a longitudinal sectional front view of the whole of a pulsation damping device which is a conventional art example.
Figure 12A:
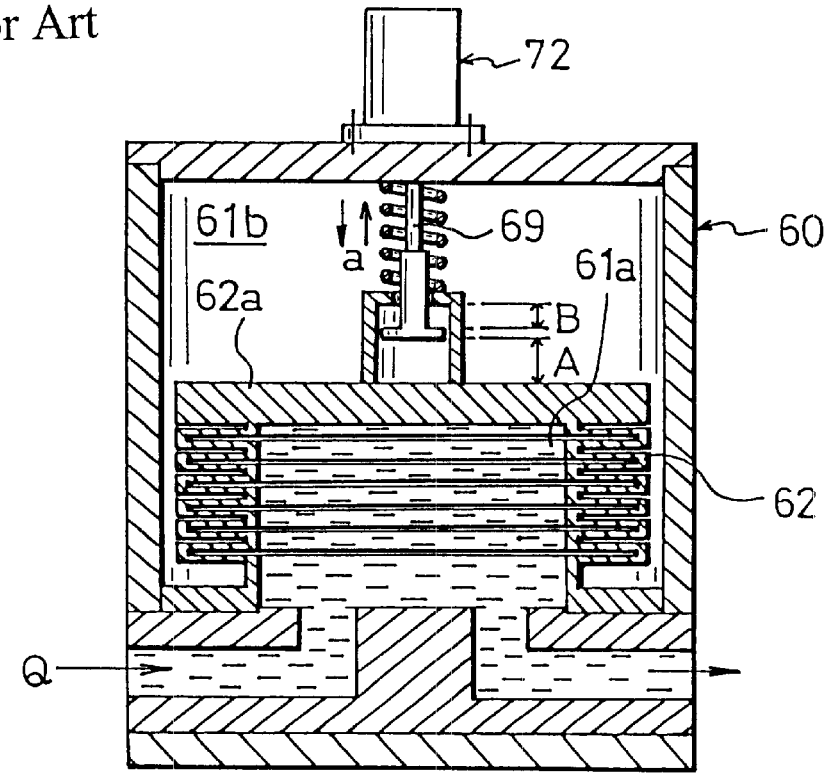
Fig. 12A Prior Art
FIG. 12A is a longitudinal sectional front view of the whole of a pulsation damping device which is another conventional art example.
Figure 12B:
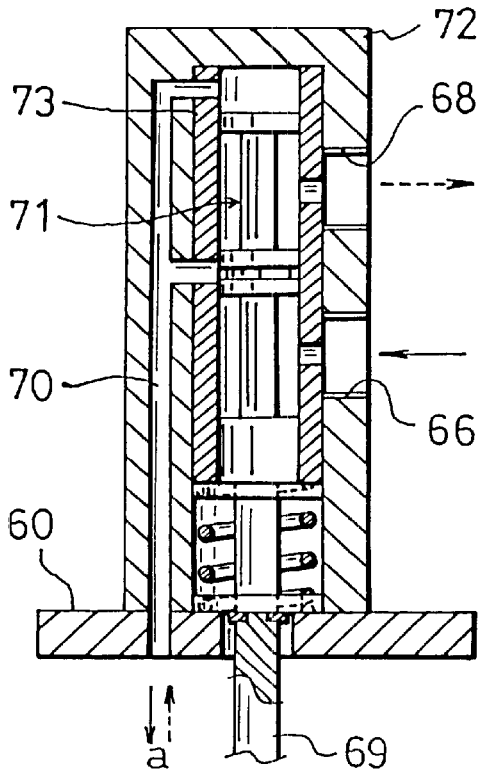
Fig. 12B Prior Art
FIG. 12B is an enlarged longitudinal sectional front view of an air supply/discharge switch valve mechanism of the pulsation damping device shown in FIG. 12A.

FIG. 10 is a longitudinal sectional front view of the whole of a pulsation damping device for a pump which is another embodiment of the invention. In the embodiment, the pulsation damping device 5 is independently configured as an accumulator with being separated from a pump. The liquid chamber 20*a* which receives and temporarily stores liquid transported by a pump (not shown) that is placed in another position, through the inflow passage 2, and which then allows the liquid to flow out from the outflow passage 3 is formed in a lower portion of the sealed device body casing 17. The air chamber 20*b* is formed in an upper portion of the device body casing 17. The liquid chamber 20*a* and the air chamber 20*b* are separated from each other by the pulsation suppression diaphragm 18. The valve casing 23 in which mechanisms that are identical with the automatic air supply valve mechanism 33 and the automatic air discharge valve mechanism 34 of the above-described embodiment are disposed is detachably fitted and fastened to the opening 27 of an upper wall 17*b* of the device body casing 17, by bolts 24 or the like. The air supply/discharge valve control plate 28 is placed so as to abut against the center portion of the closed end face 18*b* of the pulsation suppression diaphragm 18. The pulsation damping device 5, the automatic air supply valve mechanism 33, and the automatic air discharge valve mechanism 34 are configured and operate in the same manner as those of the above-described embodiment, and hence their description is omitted.

What is claimed is:

1. A pulsation damping device comprising: a sealed device body casing having a liquid chamber which receives liquid to be transported by a reciprocal pump or the like through an inflow passage, which temporarily stores the liquid, and which then allows the liquid to flow out through an outflow passage, and an air chamber which is to be filled with compressed air for suppressing pulsation; and a pulsation suppression diaphragm which is disposed in said device body casing to separate said liquid chamber and said air chamber from each other, and which is freely extended and contracted in accordance with a balance between variations in flow quantity and pressure of the transported liquid flowing into said liquid chamber, and an air filling pressure of said air chamber, wherein said pulsation damping device includes:

a valve casing which is placed in said air chamber to be opposed to a center portion of a closed end face of said pulsation suppression diaphragm, said closed end face facing said air chamber, and which has an air supply port through which, when the air filling pressure of said air chamber is to be raised, the compressed air is introduced into said air chamber, and an air discharge port through which, when the air filling pressure of said air chamber is to be lowered, the compressed air is discharged from said air chamber to an outside;

an air supply valve which is disposed in said valve casing, and which opens and closes said air supply port, and a spring which always closingly urges said air supply valve;

an air discharge valve which is disposed in said valve casing to be juxtaposed with said air supply valve, and which opens and closes said air discharge port, and a spring which always closingly urges said air discharge valve;

an air supply/discharge valve control plate which is placed to abut against the center portion of said closed end face of said pulsation suppression diaphragm;

an air supply valve rod pressing portion which is disposed on said air supply/discharge valve control plate, and which pushes a rear end portion of a valve rod of said air supply valve to open said air supply valve, in accordance with that the liquid pressure of said liquid chamber is raised to overcome the air pressure of said air chamber and said pulsation suppression diaphragm is extended;

an air discharge valve rod pulling portion which is juxtaposed with said air supply valve rod pressing portion on said air supply/discharge valve control plate, which is slidably connected to a rear end portion of a valve rod of said air discharge valve, and which pulls said valve rod to open said air discharge valve, in accordance with that the liquid pressure of said liquid chamber is lowered, the air pressure of said air chamber overcomes the liquid pressure of said liquid chamber, and said pulsation suppression diaphragm is contracted; and springs which are interposed between said valve casing and said air supply/discharge valve control plate to respectively surround outer peripheries of said air supply valve rod and said air discharge valve rod, and which pressingly urge said air supply/discharge valve control plate toward the center portion of said closed end face of said pulsation suppression diaphragm.

2. A pulsation damping device according to claim 1, wherein said valve casing and said air supply/discharge valve control plate are connected to each other by a guide shaft which is parallel to extending and contracting directions of said pulsation suppression diaphragm, and said air supply/discharge valve control plate is moved in parallel along said guide shaft.

3. A pulsation damping device according to claim 2, wherein said guide shaft is disposed in a plural number.

4. A pulsation damping device according to claim 1, wherein said valve casing is detachably attached to said device body casing.

5. A pulsation damping device according to claim 2, wherein said valve casing is detachably attached to said device body casing.

6. A pulsation damping device according to claim 3, wherein said valve casing is detachably attached to said device body casing.

7. A pulsation damping device according to claim 1, wherein an air driven reciprocal pump portion is integrally attached to said device body casing, said reciprocal pump portion comprises: a pump casing which is disposed integrally with one side portion of said device body casing; a pump diaphragm which is disposed in said pump casing to be opposed to said pulsation suppression diaphragm, and which is extendingly and contractingly deformable in the extending and contracting directions of said pulsation suppression diaphragm; an air cylinder portion which drives said pump diaphragm to extend and contract said diaphragm; and a pump working chamber in which check valves are disposed inside said pump diaphragm, said check valves being alternately opened and closed in accordance with extending and contracting deformation of said pump diaphragm to perform actions of sucking and discharging the transported liquid, and the transported liquid which is discharged from said pump working chamber via said discharge check valve is temporarily sent into said liquid chamber.

8. A pulsation damping device according to claim 2, wherein an air driven reciprocal pump portion is integrally attached to said device body casing, said reciprocal pump portion comprises: a pump casing which is disposed integrally with one side portion of said device body casing; a pump diaphragm which is disposed in said pump casing to be opposed to said pulsation suppression diaphragm, and which is extendingly and contractingly deformable in the extending and contracting directions of said pulsation suppression diaphragm; an air cylinder portion which drives said pump diaphragm to extend and contract said diaphragm; and a pump working chamber in which check valves are disposed inside said pump diaphragm, said check valves being alternately opened and closed in accordance with extending and contracting deformation of said pump diaphragm to perform actions of sucking and discharging the transported liquid, and the transported liquid which is discharged from said pump working chamber via said discharge check valve is temporarily sent into said liquid chamber.

9. A pulsation damping device according to claim 3, wherein an air driven reciprocal pump portion is integrally attached to said device body casing, said reciprocal pump portion comprises: a pump casing which is disposed integrally with one side portion of said device body casing; a pump diaphragm which is disposed in said pump casing to be opposed to said pulsation suppression diaphragm, and which is extendingly and contractingly deformable in the extending and contracting directions of said pulsation suppression diaphragm; an air cylinder portion which drives said pump diaphragm to extend and contract said diaphragm; and a pump working chamber in which check valves are disposed inside said pump diaphragm, said check valves being alternately opened and closed in accordance with extending and contracting deformation of said pump diaphragm to perform actions of sucking and discharging the transported liquid, and the transported liquid which is discharged from said pump working chamber via said discharge check valve is temporarily sent into said liquid chamber.

10. A pulsation damping device according to claim 4, wherein an air driven reciprocal pump portion is integrally attached to said device body casing, said reciprocal pump portion comprises: a pump casing which is disposed integrally with one side portion of said device body casing; a pump diaphragm which is disposed in said pump casing to be opposed to said pulsation suppression diaphragm, and which is extendingly and contractingly deformable in the extending and contracting directions of said pulsation suppression diaphragm; an air cylinder portion which drives said pump diaphragm to extend and contract said diaphragm; and a pump working chamber in which check valves are disposed inside said pump diaphragm, said check valves being alternately opened and closed in accordance with extending and contracting deformation of said pump diaphragm to perform actions of sucking and discharging the transported liquid, and the transported liquid which is discharged from said pump working chamber via said discharge check valve is temporarily sent into said liquid chamber.

11. A pulsation damping device according to claim 5, wherein an air driven reciprocal pump portion is integrally attached to said device body casing, said reciprocal pump portion comprises: a pump casing which is disposed integrally with one side portion of said device body casing; a pump diaphragm which is disposed in said pump casing to be opposed to said pulsation suppression diaphragm, and which is extendingly and contractingly deformable in the extending and contracting directions of said pulsation suppression diaphragm; an air cylinder portion which drives said pump diaphragm to extend and contract said diaphragm; and a pump working chamber in which check valves are disposed inside said pump diaphragm, said check valves being alternately opened and closed in accordance with extending and contracting deformation of said pump diaphragm to perform actions of sucking and discharging the transported liquid, and the transported liquid which is discharged from said pump working chamber via said discharge check valve is temporarily sent into said liquid chamber.

12. A pulsation damping device according to claim 6, wherein an air driven reciprocal pump portion is integrally attached to said device body casing, said reciprocal pump portion comprises: a pump casing which is disposed integrally with one side portion of said device body casing; a pump diaphragm which is disposed in said pump casing to be opposed to said pulsation suppression diaphragm, and which is extendingly and contractingly deformable in the extending and contracting directions of said pulsation suppression diaphragm; an air cylinder portion which drives said pump diaphragm to extend and contract said diaphragm; and a pump working chamber in which check valves are disposed inside said pump diaphragm, said check valves being alternately opened and closed in accordance with extending and contracting deformation of said pump diaphragm to perform actions of sucking and discharging the transported liquid, and the transported liquid which is discharged from said pump working chamber via said discharge check valve is temporarily sent into said liquid chamber.

13. A pulsation damping device according to claim 1, wherein, in said air discharge valve rod pulling portion, a sleeve which has a guide hole portion in a front end portion is disposed on said air supply/discharge valve control plate to be juxtaposed with said air supply valve rod pressing portion, and a rear end portion of said air discharge valve rod is slidably passed through said guide hole portion of said sleeve so as to be prevented from slipping off, said rear end portion having a flange.

14. A pulsation damping device according to claim 2, wherein, in said air discharge valve rod pulling portion, a sleeve which has a guide hole portion in a front end portion is disposed on said air supply/discharge valve control plate to be juxtaposed with said air supply valve rod pressing portion, and a rear end portion of said air discharge valve rod is slidably passed through said guide hole portion of said sleeve so as to be prevented from slipping off, said rear end portion having a flange.

15. A pulsation damping device according to claim 3, wherein, in said air discharge valve rod pulling portion, a sleeve which has a guide hole portion in a front end portion is disposed on said air supply/discharge valve control plate to be juxtaposed with said air supply valve rod pressing portion, and a rear end portion of said air discharge valve rod is slidably passed through said guide hole portion of said sleeve so as to be prevented from slipping off, said rear end portion having a flange.

16. A pulsation damping device according to claim 4, wherein, in said air discharge valve rod pulling portion, a sleeve which has a guide hole portion in a front end portion is disposed on said air supply/discharge valve control plate to be juxtaposed with said air supply valve rod pressing portion, and a rear end portion of said air discharge valve rod is slidably passed through said guide hole portion of said sleeve so as to be prevented from slipping off, said rear end portion having a flange.

17. A pulsation damping device according to claim 5, wherein, in said air discharge valve rod pulling portion, a sleeve which has a guide hole portion in a front end portion is disposed on said air supply/discharge valve control plate to be juxtaposed with said air supply valve rod pressing portion, and a rear end portion of said air discharge valve rod is slidably passed through said guide hole portion of said sleeve so as to be prevented from slipping off, said rear end portion having a flange.

18. A pulsation damping device according to claim 6, wherein, in said air discharge valve rod pulling portion, a sleeve which has a guide hole portion in a front end portion is disposed on said air supply/discharge valve control plate to be juxtaposed with said air supply valve rod pressing portion, and a rear end portion of said air discharge valve rod is slidably passed through said guide hole portion of said sleeve so as to be prevented from slipping off, said rear end portion having a flange.

19. A pulsation damping device according to claim 1, wherein, in said air discharge valve rod pulling portion, a sleeve which has a guide hole portion in a front end portion is disposed on said air supply/discharge valve control plate to be juxtaposed with said air supply valve rod pressing portion, a rear end portion of said air discharge valve rod is slidably passed through said guide hole portion of said sleeve so as to be prevented from slipping off, said rear end portion having a flange, and a root portion of said air discharge valve rod with respect to said air discharge valve is slidably passed through a valve rod guide hole portion of an air discharge valve rod holder which is disposed in said valve casing.

20. A pulsation damping device according to claim 2, wherein, in said air discharge valve rod pulling portion, a sleeve which has a guide hole portion in a front end portion is disposed on said air supply/discharge valve control plate to be juxtaposed with said air supply valve rod pressing portion, a rear end portion of said air discharge valve rod is slidably passed through said guide hole portion of said sleeve so as to be prevented from slipping off, said rear end portion having a flange, and a root portion of said air discharge valve rod with respect to said air discharge valve is slidably passed through a valve rod guide hole portion of an air discharge valve rod holder which is disposed in said valve casing.

21. A pulsation damping device according to claim 3, wherein, in said air discharge valve rod pulling portion, a sleeve which has a guide hole portion in a front end portion is disposed on said air supply/discharge valve control plate to be juxtaposed with said air supply valve rod pressing portion, a rear end portion of said air discharge valve rod is slidably passed through said guide hole portion of said sleeve so as to be prevented from slipping off, said rear end portion having a flange, and a root portion of said air discharge valve rod with respect to said air discharge valve is slidably passed through a valve rod guide hole portion of an air discharge valve rod holder which is disposed in said valve casing.

22. A pulsation damping device according to claim 4, wherein, in said air discharge valve rod pulling portion, a sleeve which has a guide hole portion in a front end portion is disposed on said air supply/discharge valve control plate to be juxtaposed with said air supply valve rod pressing portion, a rear end portion of said air discharge valve rod is slidably passed through said guide hole portion of said sleeve so as to be prevented from slipping off, said rear end portion having a flange, and a root portion of said air discharge valve rod with respect to said air discharge valve is slidably passed through a valve rod guide hole portion of an air discharge valve rod holder which is disposed in said valve casing.

23. A pulsation damping device according to claim 5, wherein, in said air discharge valve rod pulling portion, a sleeve which has a guide hole portion in a front end portion is disposed on said air supply/discharge valve control plate to be juxtaposed with said air supply valve rod pressing portion, a rear end portion of said air discharge valve rod is slidably passed through said guide hole portion of said sleeve so as to be prevented from slipping off, said rear end portion having a flange, and a root portion of said air discharge valve rod with respect to said air discharge valve is slidably passed through a valve rod guide hole portion of an air discharge valve rod holder which is disposed in said valve casing.

24. A pulsation damping device according to claim 6, wherein, in said air discharge valve rod pulling portion, a sleeve which has a guide hole portion in a front end portion is disposed on said air supply/discharge valve control plate to be juxtaposed with said air supply valve rod pressing portion, a rear end portion of said air discharge valve rod is slidably passed through said guide hole portion of said sleeve so as to be prevented from slipping off, said rear end portion having a flange, and a root portion of said air discharge valve rod with respect to said air discharge valve is slidably passed through a valve rod guide hole portion of an air discharge valve rod holder which is disposed in said valve casing.

25. A pulsation damping device according to claim 1, wherein said air supply valve rod is slidably passed through a valve rod pass hole of an air supply valve holder which is disposed in said valve casing, said valve rod pass hole being formed in a rear end portion of said air supply valve holder, and a rear end portion of said air supply valve rod protrudes toward a rear side of said air supply valve holder.

26. A pulsation damping device according to claim 2, wherein said air supply valve rod is slidably passed through a valve rod pass hole of an air supply valve holder which is disposed in said valve casing, said valve rod pass hole being formed in a rear end portion of said air supply valve holder, and a rear end portion of said air supply valve rod protrudes toward a rear side of said air supply valve holder.

27. A pulsation damping device according to claim 3, wherein said air supply valve rod is slidably passed through a valve rod pass hole of an air supply valve holder which is disposed in said valve casing, said valve rod pass hole being formed in a rear end portion of said air supply valve holder, and a rear end portion of said air supply valve rod protrudes toward a rear side of said air supply valve holder.

28. A pulsation damping device according to claim 4, wherein said air supply valve rod is slidably passed through a valve rod pass hole of an air supply valve holder which is disposed in said valve casing, said valve rod pass hole being formed in a rear end portion of said air supply valve holder, and a rear end portion of said air supply valve rod protrudes toward a rear side of said air supply valve holder.

29. A pulsation damping device according to claim 5, wherein said air supply valve rod is slidably passed through a valve rod pass hole of an air supply valve holder which is disposed in said valve casing, said valve rod pass hole being formed in a rear end portion of said air supply valve holder, and a rear end portion of said air supply valve rod protrudes toward a rear side of said air supply valve holder.

30. A pulsation damping device according to claim 6, wherein said air supply valve rod is slidably passed through a valve rod pass hole of an air supply valve holder which is disposed in said valve casing, said valve rod pass hole being formed in a rear end portion of said air supply valve holder, and a rear end portion of said air supply valve rod protrudes toward a rear side of said air supply valve holder.

31. A pulsation damping device according to claim 2, wherein a front end portion of said guide shaft is coupled integrally with said valve casing, and a rear end portion of said guide shaft is slidably passed through a guide sleeve fixed to said air supply/discharge valve control plate so as to be prevented from slipping off, said rear end portion having a flange.

32. A pulsation damping device according to claim 3, wherein a front end portion of each of said guide shafts is coupled integrally with said valve casing, and a rear end portion of said guide shaft is slidably passed through a guide sleeve fixed to said air supply/discharge valve control plate so as to be prevented from slipping off, said rear end portion having a flange.

* * * * *